United States Patent [19]

Zubaty et al.

[11] 4,246,558

[45] Jan. 20, 1981

[54] AUXILIARY FEATURE MODULES FOR CIRCUIT BREAKERS

[75] Inventors: Martin V. Zubaty, Bellefontaine, Ohio; Carl E. Gryctko, Cherry Hill, N.J.

[73] Assignee: Gould Inc., Rolling Meadows, Ill.

[21] Appl. No.: 5,189

[22] Filed: Jan. 22, 1979

[51] Int. Cl.[3] ..... H01H 83/00

[52] U.S. Cl. ..... 335/20; 335/10; 335/26

[58] Field of Search ..... 335/20, 8, 9, 10, 160, 335/26, 27, 21, 22, 6, 155, 23

[56] References Cited

U.S. PATENT DOCUMENTS

| | | | |
|---|---|---|---|
| 3,717,792 | 2/1973 | Gryctko | 335/20 |
| 4,041,423 | 8/1977 | Ophaug et al. | 335/20 |
| 4,079,346 | 3/1978 | Rys | 335/23 |
| 4,090,157 | 5/1978 | Rys | 335/8 |
| 4,112,270 | 9/1978 | Rys | 335/10 |
| 4,114,122 | 9/1978 | Grenier | 335/8 |

*Primary Examiner*—Harold Broome
*Attorney, Agent, or Firm*—Harold Huberfeld

[57] ABSTRACT

Both undervoltage and shunt trip auxiliary feature modules, adapted to be mounted side-by-side with one or more circuit breaker modules include an electromagnetic trip device having a trip actuator which is biased toward tripping position and is normally latched in a reset position. A lost motion connection interconnects the actuator with a trip member which is in direct driving engagement with the releasable latch for the automatic trip means of the circuit breaker so that when the actuator is released, movement thereof is transmitted through the trip member to the circuit breaker latch for tripping of the latter. Each auxiliary feature module also includes a reset member which acts to automatically reset the actuator after each tripping operation thereof. The reset member is in direct driving engagement with the cradle of the circuit breaker contact operating mechanism so that movement of the cradle towards its tripped position will operate the reset member in a direction to reset the actuator. A spring in the auxiliary feature module biases the reset member in resetting direction when the cradle is released and in so doing tends to prevent cradle rebound from its tripped position. However, this spring is connected to the reset member in such a manner that when the cradle is reset the line of action of the spring is so positioned that this spring does not contribute to loading of the circuit breaker trip latch.

16 Claims, 11 Drawing Figures

AUXILIARY FEATURE MODULES FOR CIRCUIT BREAKERS

This invention relates to circuit breakers in general and more particularly relates to auxiliary feature modules mounted externally of their associated circuit breakers and in operative mechanical relationship therewith.

U.S. Pat. No. 4,079,346 issued Mar. 14, 1978 to T. J. Rys for Mounting Plate For Molded Case Circuit Breaker describes the construction of a single pole circuit breaker module for moderately high current rating, say 150 amps. at 600 volts with an interrupting capacity of greater than 10,000 amps. This circuit breaker module is of particularly compact construction especially insofar as housing width is concerned. U.S. Pat. No. 4,090,157 issued May 16, 1978 to T. J. Rys for Operating Handle Means For Stacked Circuit Breaker Modules discloses means for stacking a plurality of the circuit breaker modules to form a multipole circuit interrupter.

U.S. Pat. No. 4,112,270 issued Sept. 5, 1978 to T. J. Rys for Means Connecting Circuit Breaker and Auxiliary Feature Modules discloses means for making operative mechanical connections between circuit breaker modules of this type and suitable modules containing one or more auxiliary features such as auxiliary switches, shunt trip devices, etc. More particularly, the circuit breaker module in question is constructed so that the movable contact arm, the operating mechanism cradle and the latch therefor are each keyed to their respective pivot pins. Each compatible auxiliary feature module contains at least one pivot extension each of which projects sideways through a side opening in the circuit breaker housing and interengages a complementary formation of an appropriate pivot pin of the circuit breaker module so that pivoted elements of the circuit breaker and auxiliary feature modules are keyed together for operation in unison. In this manner, switches may be operated by the contact arm and cradle, and the latch may be operated by shunt trip and/or undervoltage devices.

The instant invention is concerned with details of auxiliary feature modules used for shunt and undervoltage tripping. Pursuant to the instant invention, these modules utilize electromagnetic trip devices generally of the same size and having identical trip actuators biased toward tripping position and normally latched in a reset position. A lost motion connection connects the actuator with a trip member keyed to the circuit breaker latch. The trip actuator is automatically reset by a reset member of the auxiliary feature module which is keyed to the circuit breaker cradle.

When the electromagnetic trip device operates to release the trip actuator thereby releasing the circuit breaker latch, the cradle is released and moves to its trip position under the force exerted by the main springs of the circuit breaker. The auxiliary feature module is provided with a spring that acts on the reset member so that the latter exerts a force in the tripping direction on the released cradle to prevent rebound thereof. This spring of the auxiliary feature module moves the reset member in a direction to reset the actuator while the cradle moves toward its tripped position. Resetting of the cradle moves the reset member opposite to its resetting direction, but by that time the actuator is latched and poised for releasing the circuit breaker latch.

When the cradle is latched, the spring of the auxiliary feature module is positioned so as not to exert a force on the cradle whereby the tripping force to release the circuit breaker latch is the same whether the circuit breaker is or is not connected with the auxiliary feature module.

Accordingly, a primary object of the instant invention is to provide compact auxiliary feature modules operable in conjunction with a circuit breaker module of moderately high capacity.

Another object of this invention is to provide an auxiliary feature module having means for automatically resetting a trip actuator which is part of an electromagnetic trip device constructed either as a shunt trip or undervoltage trip.

Still another object of this invention is to provide an auxiliary feature module having an automatic reset member which is keyed to the circuit breaker cradle and biased so as to prevent cradle rebound when automatic tripping occurs.

A further object of this invention is to provide an auxiliary feature module having a biased automatic reset member keyed to the circuit breaker cradle in such a manner that the biasing means for the reset member does not increase the force required for releasing the circuit breaker latch.

These objects as well as other objects of this invention shall become readily apparent after reading the following description of the drawings in which:

FIG. 9 is an exploded perspective illustrating the operative connection between the movable contact arm and those elements in the undervoltage and shunt trip modules which are mechanically interlocked to the movable contact arm.

Figure 1:
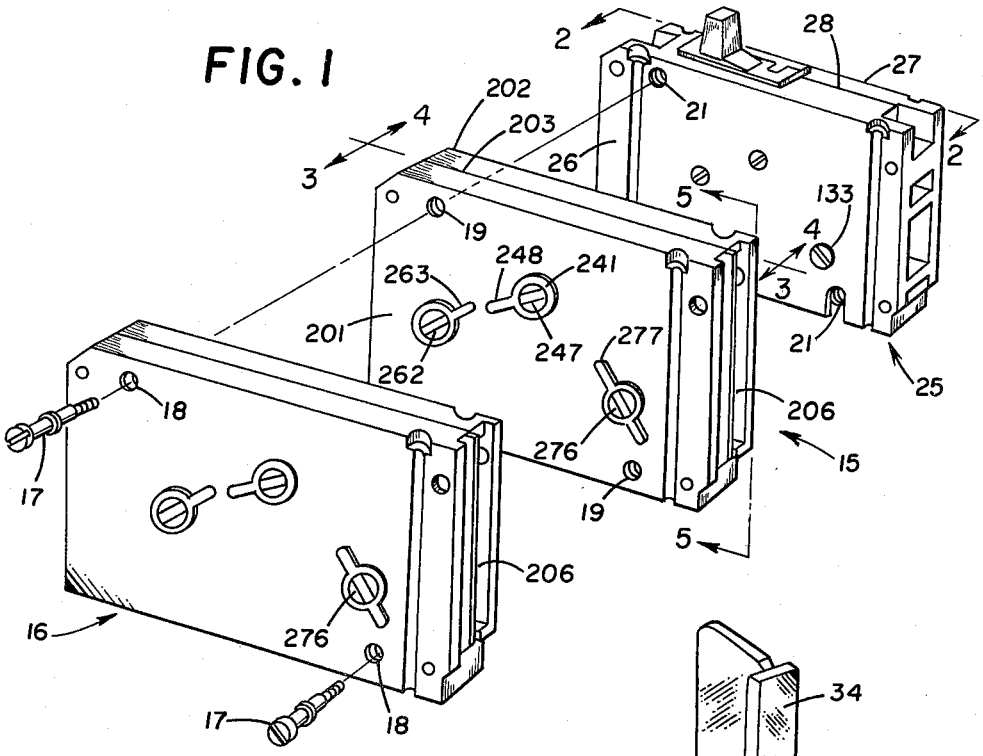
FIG. 1 is an exploded perspective showing the relationship between a circuit breaker and two auxiliary feature modules constructed in accordance with teachings of the instant invention.

Now referring to the Figures, wherein FIG. 1 shows undervoltage auxiliary feature module 15, shunt trip auxiliary feature module 16, and circuit breaker module 25. The widths of all three modules 15, 16 and 25 are essentially the same, as are the length and width of the respective housing. Two screws 17 extend through two clearance apertures 18 in module 16, two clearance apertures 19 in module 15, and are threadably received in two apertures 21 in module 25 to retain modules 15, 16, 25 in a side-by-side stack.

Figure 2:
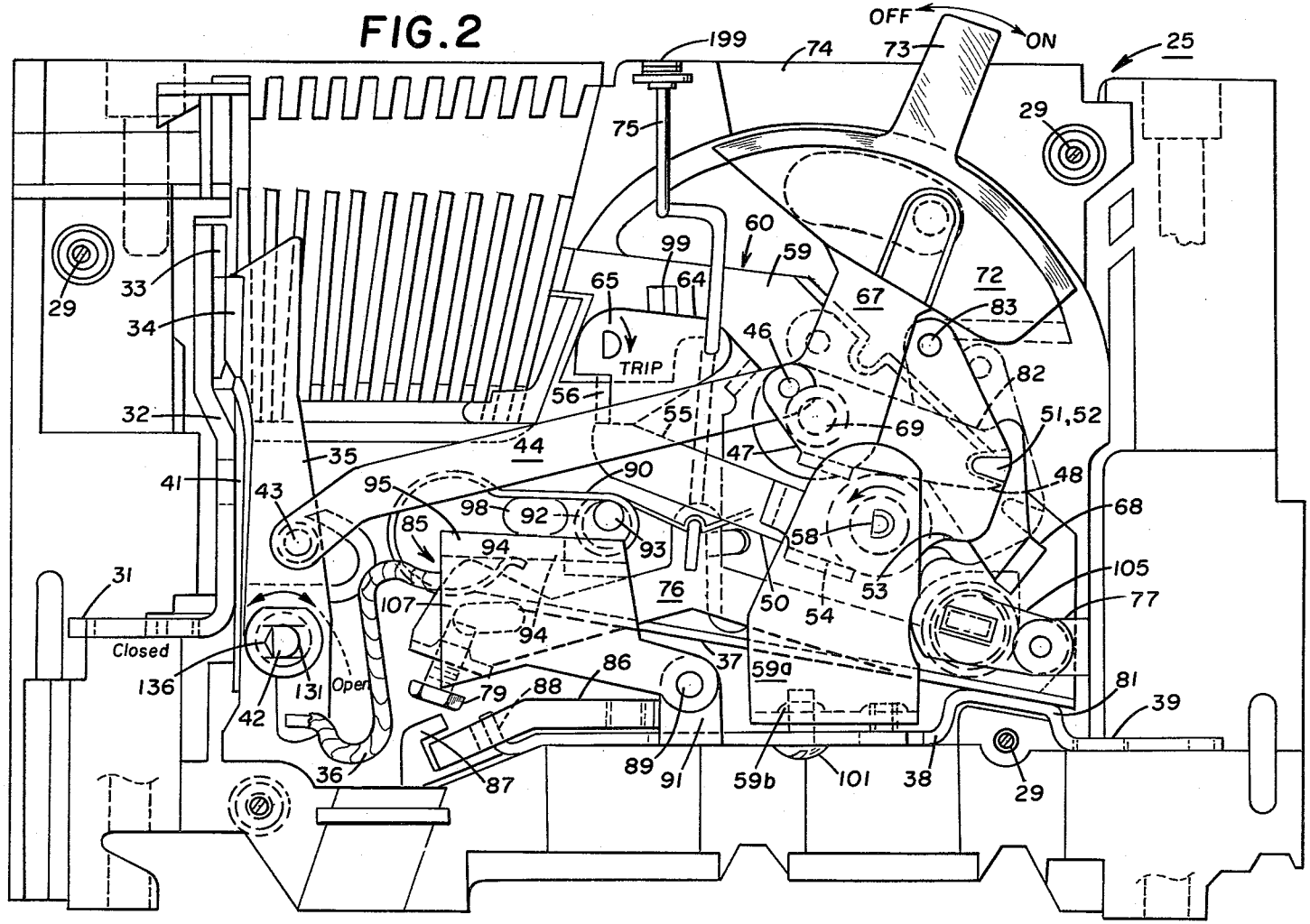
FIG. 2 is a side elevation of the circuit breaker module looking in the direction of arrows 2—2 of FIG. 1 with the module cover removed to reveal the internal elements.

As explained in detail in the aforesaid U.S. Pat. No. 4,079,346, circuit breaker pole unit or module 25 is provided with a molded insulating housing consisting of sections 26, 27 which mate at line 28 and are secured together by four rivets 29 two of which contain threaded apertures 21 which receive screws 17 that secure modules 15, 16, 25 in a stack. As seen in FIG. 2, the current carrying path through circuit breaker 25 extends from load terminal 31, to which a wire grip (not shown) may be mounted, stationary contact 33 at the end of load terminal strap 32 remote from load terminal 31, movable contact 34 at one end of movable contact arm 35, through contact arm 35 and braid 36 connected to the other end of arm 35, through bimetal 37 to line terminal member 38 whose right end 39 is positioned for mounting of a wire grip (not shown).

Thin insulating sheet 41 is interposed between movable contact arm 35 and load terminal strap 32 to electrically insulate these elements for a major portion of the length of contact arm 35. However, these elements are so close to one another that current limiting through contact blow-off is achieved by interaction of magnetic fields which accompany current flow in strap 32 and arm 35.

The lower or rear end of contact arm 35 is pivotally mounted on a fixed pivot provided by pin 42 whose ends extend into recesses in both housing portions 26 and 27. Pin 43, located at a point between movable contact 34 and pin 42, connects contact arm 35 to one end of toggle link 44 having its other end connected by pin 46 to the other toggle member 47. Link 44 consists of two identical parallel arms spaced by the thickness of contact arm 35. Toggle link 47 is a bifurcated element having parallel sections 48 each provided with a V-notch 51 which receives a boss 52 on the inner surface of the parallel walls 53 of cradle 50 which are joined by web 54. One of the walls 53 is provided with latching tip extension 55 engageable by latching protrusion 56. Aligned apertures in walls 53 receive pin 58 which pivotally mounts cradle 50 to formed mounting plate or frame 60 at aligned apertures in main wall 59 and auxiliary wall **59*a* of plate 60. Web section 59*b* connects wall 59, 59*a* in spaced parallel relationship. Screw 101 extends through a clearance aperture in terminal member 38 and is received by a threaded aperture in web 59*b* to secure mounting plate 60 to member 38**.

Cantilevered latching protrusion 56 extends perpendicular to the main planar portion of latch member 64 and is formed integrally therewith. Member 64 is pivotally mounted on plate 60 by cantilevered pivot pin 65.

The main operating spring (not shown) is a coiled tension member connected at one of its ends to toggle knee pin 46 and at the other of its ends to operating member 67 at projection 68 thereof. Member 67 is mounted to main wall 59 of mounting member 60 by pivot pin 69. The upper or forward end of operating member 67 extends into a complementary recess in the lower surface of insulating member 72. The latter includes extension or handle 73 which projects through housing opening 74 so that handle 73 is engageable for manual operation of circuit breaker 25.

Formed wire link 75 connects latch member 64 to trip member 76 at a point intermediate the ends of the latter. Member 76 is pivotally mounted at one of its ends to mounting member ear 77 by pin 78. Calibrating screw 79 is threadably mounted to end of trip member 76 remote from pin 78. The right end of the bimetal 37 is fixedly secured to inclined offset 81 of line terminal member 38 and the free end of bimetal 37 is aligned with screw 79. Upon heating of bimetal 37 due to abnormal current conditions existing for an extended period of time, the free end of bimetal 37 deflects rearward and engages screw 79 to pivot trip member 76 counterclockwise. This moves link 75 downward to pivot latch member 64 clockwise whereby latch 56 releases cradle tip 55. Now, cradle 50 pivots clockwise under the influence of the main operating spring and moves the right end of toggle 44, 47 below the line of action of the main spring so that the latter is effective to move toggle knee 46 rapidly to the right with respect to FIG. 2 causing contact arm 35 to pivot clockwise and separate movable contact 34 from stationary contact 33.

To reset cradle 50, handle 73 is moved to the left with respect to FIG. 2 with resetting surface 82 of operating member 67 engaging reset pin 83 mounted on cradle 50 to move the latter counterclockwise until latch tip 55 thereof is captured behind latch 56. Subsequent movement of handle 73 to the right with respect to FIG. 2 moves the right end of the main spring (not shown) downward until its line of action is below the right end of toggle 44, 47 at which point the main spring moves toggle knee 46 downward. This extends toggle 44, 47 thereby moving contact 34 into engagement with contact 33. For manually opening circuit breaker 25, handle 73 is moved to the left with respect to FIG. 2 and in so doing the right end of the main spring is moved above the right end of toggle 44, 47 so that the line of action of the main spring is then directed to collapse toggle 44, 47 and separate movable contact 34 from stationary contact 33.

In addition to thermal trip means provided by bimetal 37, circuit breaker 25 also includes magnetic or instantaneous trip means comprising stationary magnetic plate 86 and U-shaped armature 85 having arms 107 between which bimetal 37 extends. The left edge of plate 86 is captured under housing formation 87 and plate 86 is secured to the upwardly extending tab 88 at the left end of line terminal member 38. Pin 89 pivotally mounts armature 85 to upwardly extending ears 91 of line terminal member 38. Dual purpose formed wire spring 90 includes central looped portion 92 that receives housing formation 93. The left end of spring 90 is curved and reversely bent to engage inner surface 94 of armature 85 at its web portion 95. The right end of spring 90 is interposed between an offset end portion of link 75 and trip member 76 to bear against link 75. The loading and positioning of spring 90 is such that it biases armature 85 clockwise against housing formation stop 98 and also biases link 75 upward or forward. This biases trip member 76 clockwise about its pivot 78 and biases latch member 64 counterclockwise toward its latching position in engagement with mounting plate stop formation 99 on mounting plate 60.

The portion of link 75 forward of latch member 64 extends to engagement with insulating test-trip button 199 which is accessible for operation at the front of housing 26, 27. By rearwardly depressing button 199, link 75 is moved rearward to trip latch member 64.

Pivot pins 58, 65, the former for cradle 50 and the latter for trip latch 64, are constituted by keying rivets of generally the same construction as pin 42 for contact arm 35 (See FIG. 9). Rivet 42 includes shaft 134 and cylindrical head 132 positioned at one end of shaft 134. The free end of head 132 is provided with narrow radial slot 133 centered with respect to the cylindrical axis of shaft 134 and perpendicular thereto. In transverse section, shaft 134 consists of flat surface 136 and circular surface 131, with the latter extending for more than 180°. The aforesaid cylindrical axis coincides with the center about which circular surface 131 is generated and also coincides with the center of a bearing aperture through which shaft 134 extends. Each member (latch member 64, contact arm 35, cradle 50) mounted to a keying rivet 42 is secured thereto in keying relationship so that the angular position of rivet 42 indicates the position of the element secured thereto. As will hereinafter be seen, this becomes useful when circuit breaker pole unit 25 is operated in conjunction with auxiliary feature modules 15, 16.

Now referring more particularly to FIGS. 1 and 3 through 8 for a description of undervoltage trip module 15. The latter includes a housing constructed of molded insulating elements 201, 202 joined at line 203 and secured together by four screws 207. As seen best in FIG. 5, the end of module 15 adjacent to the load end of circuit breaker module 25 is provided with two rows of terminals 204, 205 mounted in recesses of the respective housing parts 201, 202 and separated by insulating sheet 206. Terminals 204, 205 are accessible from outside of housing 201, 202 so that it is not necessary to open the latter in order to make electrical connections to the elements disposed therein.

Figure 3:
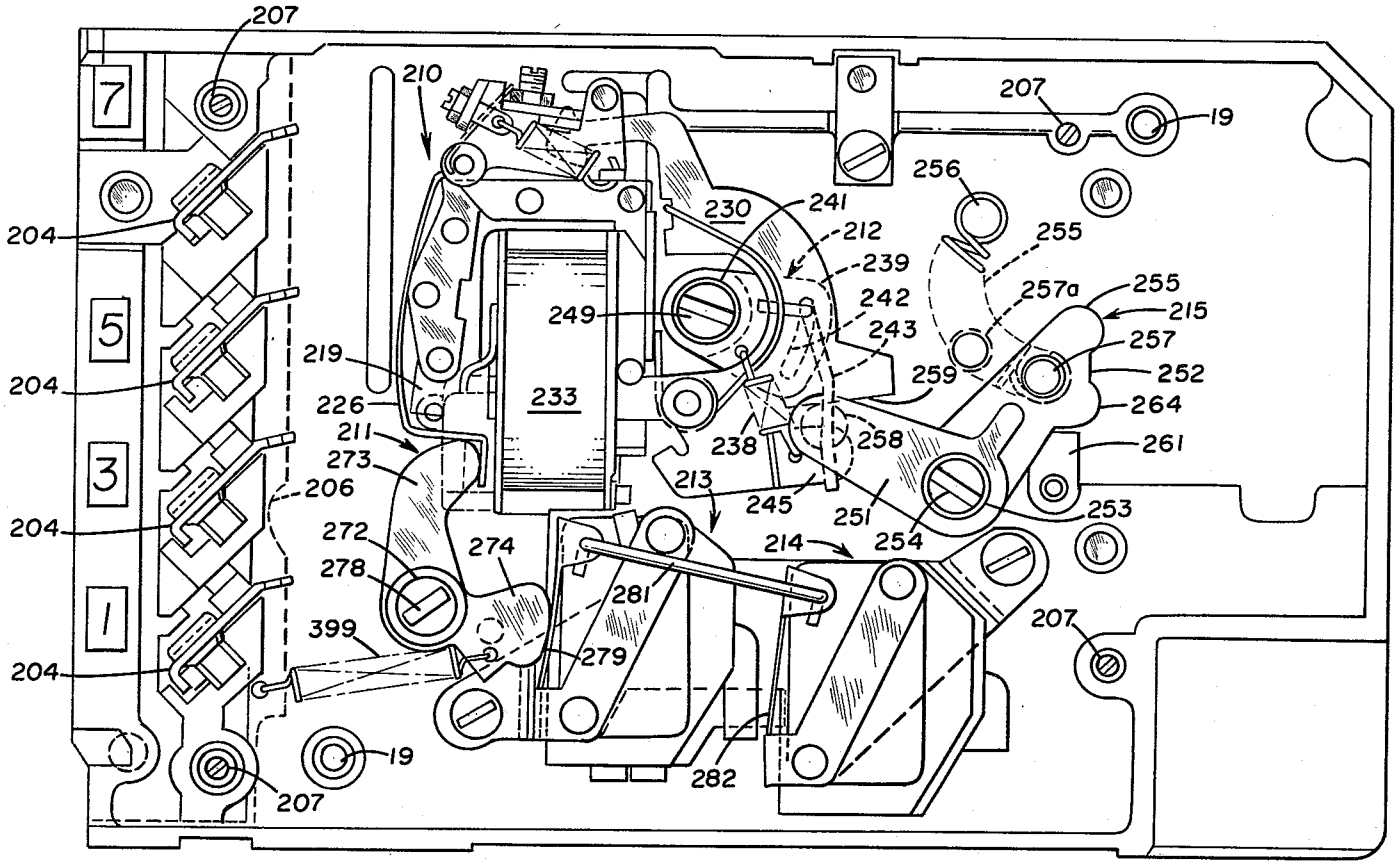
FIG. 3 is a side elevation of the undervoltage trip module looking in the direction of arrows 3—3 of FIG. 1 with the near housing half, or cover, and elements mounted thereto removed.
Figure 4:
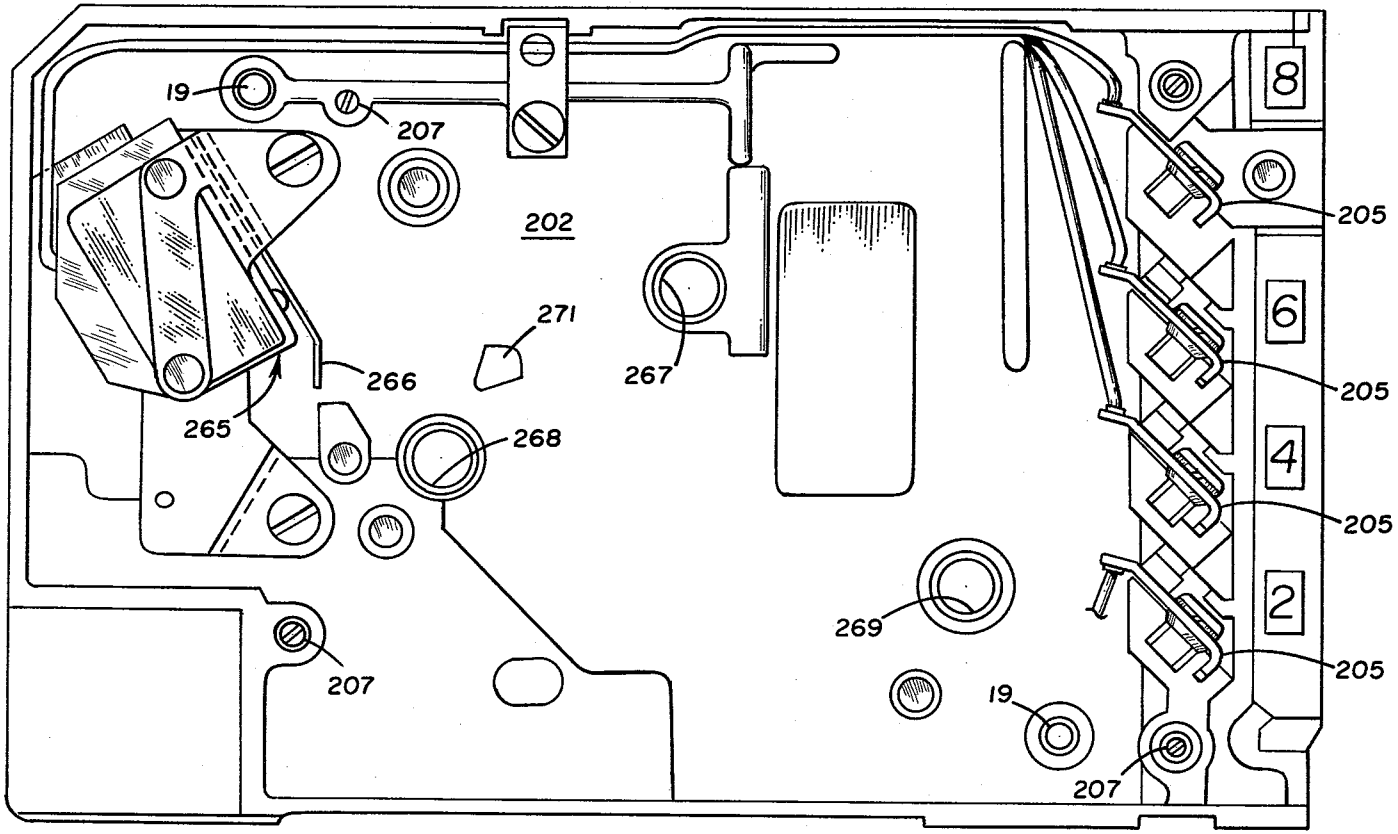
FIG. 4 is a side elevation of the cover for the undervoltage trip module and elements mounted thereto, looking in the direction of arrows 4—4 of FIG. 1.

As seen best in FIG. 3, housing part 201 also mounts electromagnetic undervoltage trip device 210, auxiliary switch operator 211, trip member 212, auxiliary switches 213, 214, and automatic reset member 215. As will hereinafter be seen, elements 211, 212 and 215 are pivotally mounted and are keyed to movable contact arm 35, latch 64 and cradle 50, respectively, of circuit breaker 25.

Figure 6:
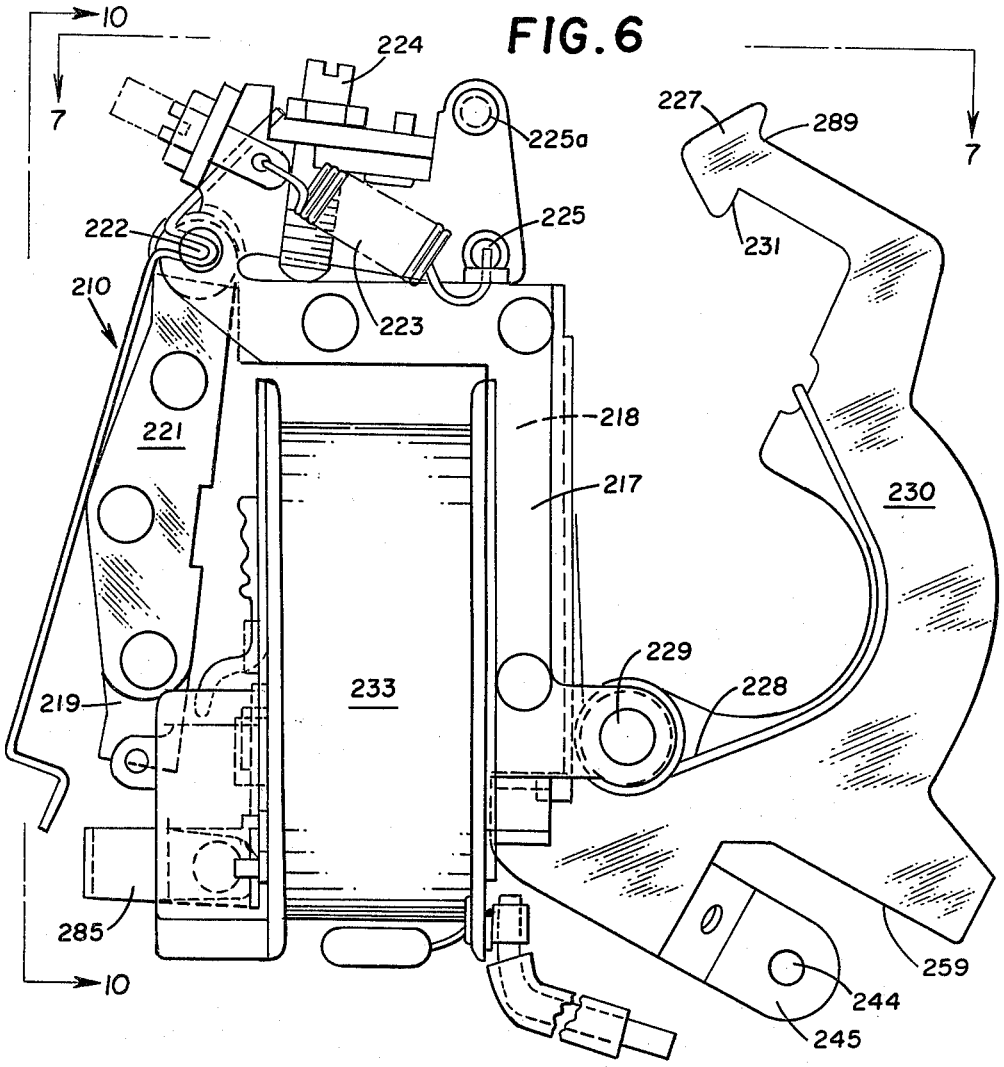
FIG. 6 is an enlarged side elevation of the electromagnetic trip device of the undervoltage trip module.
Figure 7:
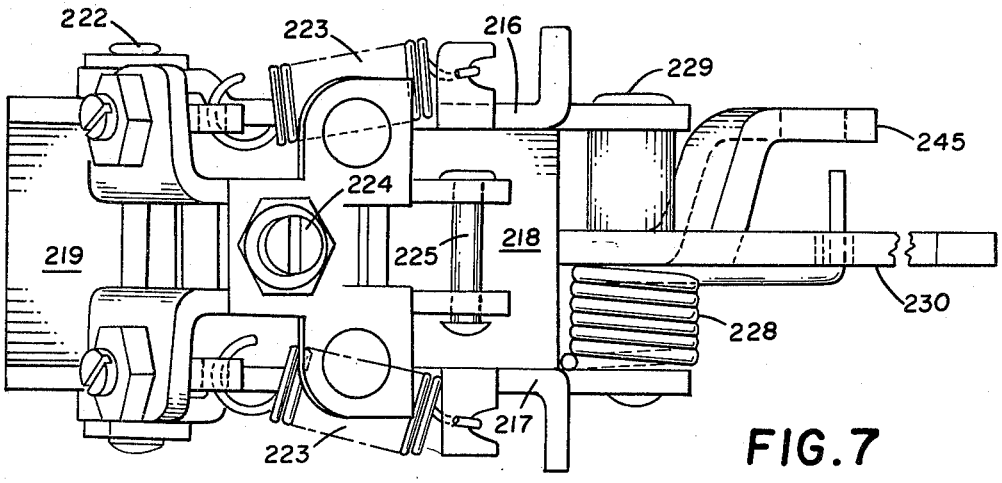
FIG. 7 is a front elevation of the trip device of FIG. 6 looking in the direction of arrows 7—7.
Figure 8:
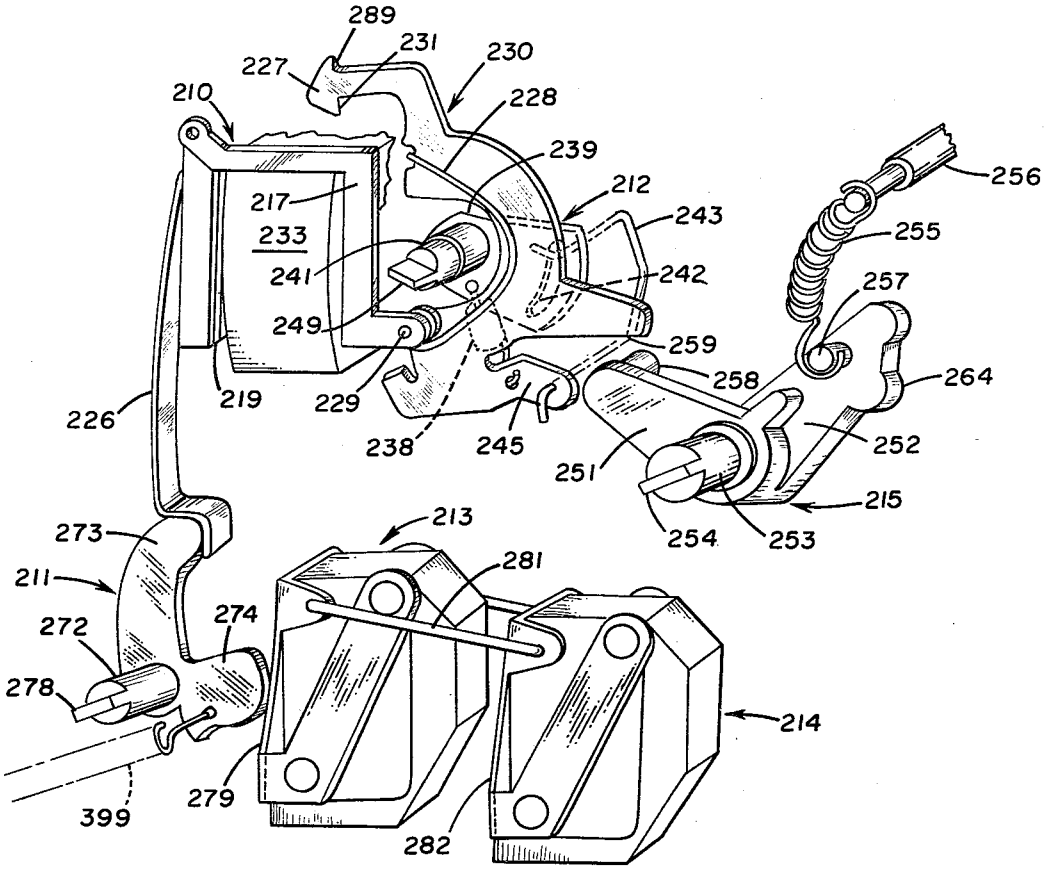
FIG. 8 is an exploded perspective showing the operative relationship of the main operating elements in the undervoltage trip module.

As seen best in FIGS. 6 and 7, device 210 includes side frame members 216, 217 having laminated stationary magnetic frame 218 clamped therebetween. The laminents forming magnetic armature 219 are disposed between spaced arms formed in movable frame member 221 which is pivotally mounted on pin 222 to stationary frame members 216, 217. A pair of coiled tension spring 223 bias the end of armature 219 remote from pivot 222 away from stationary magnetic frame 218. Screw 224, threadably mounted to movable frame 221, is engageable with stationary magnetic frame 218 to set the maximum air gap between armature 219 and frame 218. Leaf spring member 226 is pivotally mounted on pin 222 and is engageable with armature 219 for resetting thereof in conjunction with operator 211, as will hereinafter be seen. Pin 225 mounted to movable frame 221 is engageable with tip 227 for latching of trip actuator 230.

The latter is pivotally mounted at the end thereof remote from tip 227 on pin 229 which extends between stationary frame members 216, 217. Torsion spring 228, wound around pin 229, biases trip actuator 230 clockwise with respect to FIG. 3 toward its tripping position shown in FIG. 6. With operator 211 in the circuit breaker open position of FIG. 3, reset spring 226 is operated by member 211 to a position wherein spring 226 holds armature 219 in a position relatively close to stationary magnetic frame 218 so that upon energization of magnet coil 233, armature 219 will have a counterclockwise force acting thereon. This counterclockwise force holds pins 225 captured in recess 231 of trip actuator 230 to hold actuator 230 in its reset position of FIG. 3. When the energizing voltage for coil 233 falls below a predetermined level, the force exerted by springs 223 moves frame 221 clockwise carrying pin 225 downward with respect to FIG. 3 and out of recess 231 thereby releasing tip 227 of trip actuator 230. Now, under the influence of biasing spring 228, trip actuator 230 pivots in a clockwise or tripping direction to the trip position of FIG. 6.

Trip member 212 is a molded plastic element having plate-like main section 239 and transverse cylindrical bearing formation 241 which extends beyond both surfaces of section 239. Bearing formation 241 is mounted in cylindrical bearing apertures at the sides of housing members 201, 202 so as to pivotally support trip member 212. The latter is provided with arcuate slot 242 which receives one end of formed wire link 243 whose other end is received by the aperture 244 in offset ear 245 of trip actuator 230 so as to provide an operative lost motion connection between actuator 230 and trip member 212. As will hereinafter be seen, when tip 227 is released and trip actuator 230 pivots to its clockwise position of FIG. 6, trip member 212 is pivoted in a clockwise direction with respect to FIG. 3 and in so doing trips circuit breaker latch 64 to release cradle 50. Coiled tension spring 238, connected between section 239 and ear 245 biases trip member 212 clockwise to proper position for connecting UV module 15 to circuit breaker module 25. In this position keying slot 247 (FIG. 1) in the end of bearing formation 241 remote from circuit breaker 25 is aligned with marker 248 on the outside of housing section 201. The other end of bearing formation 241 is provided with blade-like keying formation 249 which projects into a complementary slot of pivot pin 65 for circuit breaker latch 64 whereby the latter is keyed to trip member 212.

Trip actuator 230 is operated to its reset position of FIG. 3 by reset member 215. The latter is a molded plastic member having arms 251, 252 which radiate from bearing section 253 which is supported in aligned bearing sections in housing parts 201, 202. One end of bearing section 253 is provided with blade-like extension 254 which is entered into complementary slot in pivot 58 for circuit breaker cradle 50 whereby the latter is mechanically connected to pivot in unison with reset member 215. Coiled compression spring 255 is connected between post 256 in housing part 201 and post 257 on reset member arm 252 to bias reset member 257 in a clockwise or resetting direction with respect to FIG. 3. The resetting force generated by spring 255 is transmitted to trip actuator 230 by projection 258 on arm 251, with projection 258 riding along edge portion 259 of actuator 230. Formation 261 of housing section 201 serves as a stop to limit clockwise or resetting motion of member 215.

When resetting member 215 is in its resetting position of FIG. 3, circuit breaker cradle 50 is in its tripped position. In this position of resetting member 215, slot 262 at the end of bearing formation 253 remote from keying blade 254 is positioned in alignment with marker 263. This is the mounting orientation for resetting member 215. When circuit breaker cradle 50 is moved to its reset position of FIG. 2, resetting member 215 is pivoted counterclockwise with respect to FIG. 3 until post 257 moves to the position indicated in phantom as 257*a*. In this position of resetting member 215, post 257 is positioned on a straight line extending between post 256 and bearing section 253 so that the line of action for spring 255 is directed through the pivot for resetting member 215 and is ineffective to exert a biasing force tending to rotate resetting member 215. Because of this, when cradle 50 is reset, spring 255 does not exert a force which is transmitted through cradle 50 to circuit breaker latch 56. However, as soon as cradle 50 begins to move toward its tripped position, spring 255 exerts a force which pivots resetting member 215 in its clockwise or resetting direction with respect to FIG. 3. This force is transmitted through keying blade 254 to urge cradle 50 toward its tripped position and in so doing prevents rebound of cradle 50 toward its latched position.

When resetting member 215 is in its tripped position as in FIG. 3, nose 264 on arm 252 engages spring arm 266 of normally open alarm switch 265 (FIG. 4) to close the latter. Switch 265 is secured to the inside surface of housing section 202. Housing section 202 is also provided with integral formation 271 which also acts as a stop when resetting member 215 is in its reset position of FIG. 3. Further, housing section 202 is provided with bearing apertures 267, 268, 269 which receive an end of the respective bearing formations 241, 253, 272.

The latter bearing formation 272 is integrally formed with the molded plastic member constituting operator 211 which also includes arms 273, 274 extending radially from bearing formation 272. One end of bearing formation 272 is provided with slot 276 which, when in alignment with indicator 277 on the outside of housing section 201, shows that operator 211 is in the proper angular position for engagement with circuit breaker movable contact arm 35 when the latter is in open circuit position. The other end of bearing formation 272 is provided with keying blade 278 which is received by a complimentary slot in pivot pin 42 for circuit breaker movable contact arm 35.

In FIG. 3, operator 211 is shown in the circuit breaker Off position, toward which it is biased by coiled tension spring 399 connected between insulator 206 and operator arm 274. In this position of operator 211, arm 273 thereof is in engagement with spring element 226 to hold armature 219 close to its pulled in position which it will occupy when coil 233 is energized by a voltage exceeding a predetermined minimum. In this position for operator 211 arm 274 thereof is in engagement with spring arm 279 of auxiliary switch 213 to operate the latter from its normal position. Link 281 provides a driving connection between spring arm 279 and spring arm 282 of the other auxiliary switch 214 so that the latter is also operated from its normal position by arm 274 when operator 211 is in the position of FIG. 3.

Figure 10:
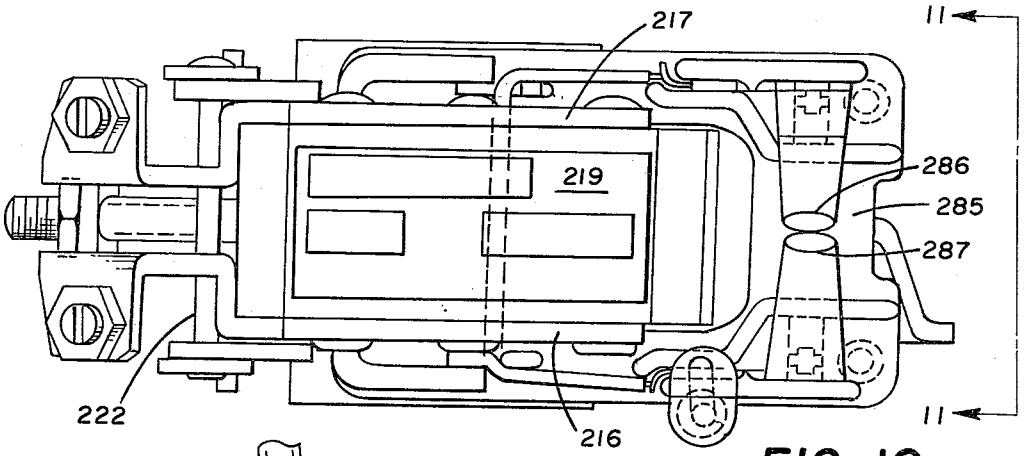
FIG. 10 is an end view of the electromagnetic tripping device looking in the direction of arrows 10—10 of FIG. 6 with such device converted for shunt trip operation.
Figure 11:
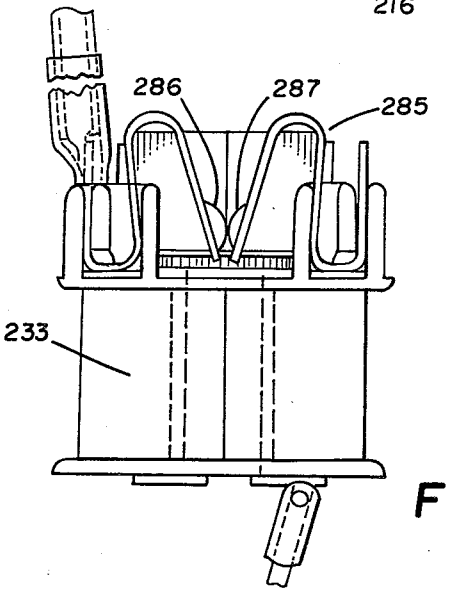
FIG. 11 is a rear elevation of the protective switch for the shunt trip device, looking in the direction of arrows 11—11 of FIG. 10.
Figure 5:
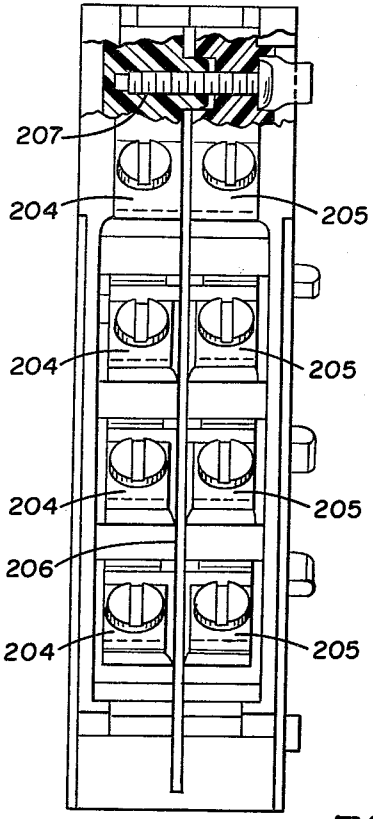
FIG. 5 is an end view of the terminal end of the undervoltage trip module, looking in the direction of arrows 5—5 of FIG. 1.

The construction of shunt trip module 16 is essentially the same as the construction for undervoltage trip module 15, the difference being in the construction of electromagnetic trip device 210. That is, for shunt trip module 16, electromagnetic trip device 210 is modified by removing spring member 226, adding safety switch 285 (FIGS. 10 and 11) and moving actuator holding pin 225 to the position indicated as 225*a* in FIG. 6. Contacts 286, 287 of switch 285 are biased toward engagement but are separated by arm 273 of operator 211 when the latter is in its position of FIG. 3 corresponding to the Open circuit position for contact arm 35. Switch 285 is in series with operating coil 233 to protect the latter from being energized when module 25 is open.

For shunt trip module 16, armature 219 is normally in the position shown in FIG. 6 wherein pin 225*a* is disposed to fall into trip actuator recess 289 when tip 227 moves to the left of pin 225*a* as viewed in FIG. 6. With pin 225*a* in recess 289 trip actuator 230 is held in its reset position and will remain in this position until shunt trip coil 233 is energized. Energization of the latter causes armature 219 to be attracted to stationary yoke 218 so that armature 219 will pivot counterclockwise moving pin 225*a* upward with respect to FIG. 6 and clear of tip 227 thereby releasing trip actuator 230. When actuator 230 is released, the force of torsion spring 228 pivots actuator 230 in a clockwise direction moving link 243 downward with respect to FIG. 3 thereby pivoting trip member 212 clockwise with respect to FIG. 3. This motion of trip member 212 is transmitted through the keying connection between member 212 and circuit breaker latch member 64 to pivot the latter to its tripped position wherein latch 56 releases cradle 50 causing tripping of circuit breaker 25.

It should now be obvious to those skilled in the art that operator 211, trip member 212 and reset member 215 of undervoltage module 15 are keyed to (in driving engagement with) corresponding elements of shunt trip module 16. However, because of the lost motion connection between actuator 230 and trip member 212 provided by slot 242 and link 243, the release of actuator 230 in one of the modules 15, 16 will not cause release of actuator 230 in the other of these modules 15, 16. Further, fault current tripping of circuit breaker 25 will not unlatch actuators 230 in either of the auxiliary module feature modules 15, 16.

Although a preferred embodiment of this invention has been described, many variations and modifications will now be apparent to those skilled in the art, and it is therefore preferred that the instant invention be limited not by the specific disclosure herein, but only by the appending claims.

What is claimed is:

1. An auxiliary feature module including an electromagnetic trip device comprising an actuator, first means biasing said actuator toward a tripping position and second means for holding said actuator in a normal reset position against the biasing force of said first means; a trip member adapted to be drivingly connected with a releasable trip latch of a circuit breaker module stacked with said auxiliary feature module; third means connecting said trip member to said actuator whereby movement of the latter to its said tripping position is transmitted through said trip member to release a circuit breaker trip latch drivingly connected thereto; and fourth means including a reset member adapted to be drivingly connected with a releasable cradle of a circuit breaker module stacked with said auxiliary feature module whereby movement of such cradle toward its tripped position is transmitted through said reset member to said actuator in a direction to reset the latter.

2. An auxiliary feature module as set forth in claim 1 in which the third means includes a lost motion connection whereby said trip member is free to move independently of said actuator when a circuit breaker trip latch drivingly connected thereto is released by circuit breaker fault current responsive trip means.

3. An auxiliary feature module as set forth in claim 1 in which said fourth means includes spring means which biases said reset member in a direction to reset said actuator when a circuit breaker cradle drivingly connected with said reset member is moving toward its tripped position and at that time to exert a force urging such circuit breaker cradle toward its tripped position.

4. An auxiliary feature module as set forth in claim 3 in which the third means includes a lost motion connection whereby said trip member is free to move independently of said actuator when a circuit breaker trip latch drivingly connected thereto is released by circuit breaker fault current responsive trip means.

5. An auxiliary feature module as set forth in claim 3 in which said spring means is operatively connected to said reset member in a manner such that with a circuit breaker cradle reset and drivingly connected with said reset member, force exerted by said spring means and appearing at a circuit breaker latch holding such cradle is essentially zero.

6. An auxiliary feature module as set forth in claim 5 in which there is a first pivot on which said reset member is mounted; said spring means having its line of action directed through and transverse to said first pivot when a circuit breaker cradle drivingly connected with said reset member is reset.

7. An auxiliary feature module as set forth in claim 1 also including an alarm switch disposed for operation by said reset member as the latter moves to positions operatively related to those of a circuit breaker cradle drivingly connected with said reset member.

8. An auxiliary feature module as set forth in claim 1 also including an operator adapted to be drivingly connected with a movable contact arm of a circuit breaker module stacked with said auxiliary feature module so that said operator is in first and second positions when such arm is respectively in circuit open and closed positions; auxiliary switch means disposed for operation by said operator as the latter moves between said first and second positions.

9. An auxiliary feature module as set forth in claim 1 also including an operator adapted to be drivingly connected with a movable contact arm of a circuit breaker module stacked with said auxiliary feature module so that said operator is in first and second positions when such arm is respectively in circuit open and closed positions; said trip device also comprising an electromagnet including a stationary yoke, an armature operatively connected to said second means and biased away from yoke to a third position wherein said second means releases said actuator and movable to a fourth position wherein said second means is effective to hold said actuator in said reset position, an operating coil which when energized at or above a predetermined voltage generates sufficient flux in said yoke to hold said armature in said fourth position; said actuator when moving toward said second position being effective to move said armature toward said fourth position.

10. An auxiliary feature module as set forth in claim 9 also including auxiliary switch means disposed for operation by said operator as the latter moves between said first and second positions.

11. An auxiliary feature module as set forth in claim 1 in which there is a first pivot on which said reset member is mounted and a second pivot on which said trip member is mounted; said first and second pivots being parallel and transversely spaced.

12. An auxiliary feature module as set forth in claim 1 in which there is a third pivot for said actuator; said third pivot being parallel to and transversely spaced with respect to said first and second pivots.

13. An auxiliary feature module as set forth in claim 12 also including an operator adapted to be drivingly connected with a movable contact arm of a circuit breaker module stacked with said auxiliary feature module so that said operator is in first and second positions when such arm is respectively in circuit open and closed positions; a fourth pivot for said operator; said fourth pivot being parallel to and transversely spaced with respect to said first, second and third pivots.

14. An auxiliary feature module as set forth in claim 1 also including a narrow insulating housing; terminal means at one end of said housing; said trip device including an operating coil electrically connected to portions of said terminal means disposed within said housing; and wire gripping means operable from outside of said housing for making removable electrical connections to said terminal means.

15. An auxiliary feature module as set forth in claim 1 also including switch means disposed within said housing and electrically connected to portions of said terminal means disposed within said housing.

16. An auxiliary feature module as set forth in claim 15 in which the terminal means includes a plurality of terminals arranged in first and second generally parallel rows each containing at least three of said terminals.

* * * * *